United States Patent [19]

Perrine et al.

[11] Patent Number: 4,515,516

[45] Date of Patent: May 7, 1985

[54] METHOD AND APPARATUS FOR COMPRESSING GASES

[75] Inventors: Paul M. Perrine; Carol-Anne Perrine, both of Salt Lake County, Utah

[73] Assignee: Champion, Perrine & Associates, Englewood, Colo.

[21] Appl. No.: 306,890

[22] Filed: Sep. 30, 1981

[51] Int. Cl.[3] ..... F04B 35/02

[52] U.S. Cl. ..... 417/38; 417/390; 417/393; 417/392; 222/3; 222/61; 222/373

[58] Field of Search ..... 417/38, 390, 394, 393, 417/540; 91/275; 222/3, 61, 373, 395; 48/174, 179, 178, 177

[56] References Cited

U.S. PATENT DOCUMENTS

| | | | |
|---|---|---|---|
| 255,222 | 3/1882 | Wang | 417/393 |
| 617,026 | 1/1899 | Keith | 417/98 |
| 636,013 | 10/1899 | Tolle | 417/390 X |
| 1,254,921 | 1/1918 | Meengs | 222/3 |
| 2,621,608 | 12/1952 | McIntyre | 417/390 |
| 2,670,874 | 3/1954 | Wilkerson | 222/61 X |
| 2,772,543 | 12/1956 | Berry | 417/394 X |
| 3,018,633 | 1/1962 | Halliwell | 222/395 X |
| 3,070,030 | 12/1962 | Mashinter | 417/390 |
| 3,355,271 | 11/1967 | Soan et al. | 48/174 |
| 3,741,692 | 6/1973 | Rupp | 417/540 |
| 4,119,113 | 10/1978 | Meginniss | 417/404 |
| 4,368,008 | 1/1983 | Budzich | 417/46 |

*Primary Examiner*—Leonard E. Smith

*Attorney, Agent, or Firm*—Mallinckrodt, Mallinckrodt, Russell & Osburn

[57] ABSTRACT

A gas compressor has at least one closed container with gas inlet means for filling the container with a gas to be compressed and gas outlet means through which compressed gas can leave the container. When the container has been filled with gas to be compressed, a fluid is forced into the container to compress the gas therein and force it out of the container. After the container has been filled with fluid and the gas forced therefrom, the fluid is drained while gas again enters and fills the container. The output of the container is generally connected to a gas storage tank and the cycle of filling the container with gas and then expelling it is repeated until a desired pressure of gas is obtained in the storage tank.

The compressor is particularly suited to filling a storage tank, such as a natural gas storage tank in a vehicle, over an extended period of time of several hours. However, a unique auxilary storage tank may be used with the compressor to provide for fast filling of another storage tank, such as the vehicle tank, by transferring substantially the entire contents of the first storage tank to the second storage tank. Such transfer is accomplished by progressively reducing the storage space of the storage tank, thus forcing the stored gas into the second tank. This is preferably done by filling the tank with a fluid, thereby forcing the gas out.

36 Claims, 6 Drawing Figures

METHOD AND APPARATUS FOR COMPRESSING GASES

BACKGROUND OF THE INVENTION

1. Field

The invention is in the field of methods and apparatus for compressing gases, particularly flammable gases such as natural gas, but also other gases such as air.

2. State of the Art

In some countries, particularly New Zealand and Italy, natural gas is used on a large scale to power automobiles. Natural gas has been found to be a very safe fuel, actually safer than gasoline. Automobiles fueled in this manner have a pressure tank for holding the natural gas at pressures up to 2400 PSI. The compression equipment needed to supply natural gas at such high pressures has to be explosion proof and is very expensive. It is generally not economically feasible to utilize such compression equipment for less than a fleet of ten vehicles.

Currently, there is no widespread use of natural gas to fuel automobiles in the United States. The problems in moving to the use of natural gas for this purpose is that fueling facilities are expensive to construct on a commercial scale, and, without a sufficient number of automobiles using natural gas as fuel, are not economically justified. On the other hand, without fueling facilities, automobiles powered by natural gas are useless. In New Zealand, the push to natural gas as an automotive fuel is spurred by the government, which subsidizes construction of refueling stations.

Since many homes in the United States are supplied with natural gas, and automobiles can be made which will run on either gasoline or natural gas by merely turning a valve, and since natural gas tanks for use with automobiles have capacity sufficient for normal daily driving, there should be great demand for such an automobile if a homeowner could refuel at home. The automobile could be used for normal daily driving, and switched to gasoline for longer trips.

SUMMARY OF THE INVENTION

According to the invention, a gas compressor that can be connected to the natural gas line in a home and used to fill an automobile tank or other natural gas storage tank to a high pressure, such as 2000 PSI or higher, comprises at least one closed container with inlet means for filling the container with gas to be compressed. When the container is full, a compression fluid is pumped into the container, thereby compressing the gas therein and forcing it through an outlet into a storage tank. The inlet means to the container blocks flow of compressed gas back into the inlet. When compression fluid reaches the desired level in the container it is drained from the container. The outlet means blocks flow from the storage tank back into the container. As the compression fluid is drained from the container, additional gas to be compressed enters the container through the inlet. When compression fluid has been drained to the desired level and the container again filled with gas to be compressed, the cycle starts over.

In one preferred embodiment, the compressor has two containers and the compression fluid is pumped between the two so that as one container is being filled with fluid and the gas therein is being compressed, the other container is being drained at the same rate and is filling with gas to be compressed.

Generally no dividers are required in the containers to separate the gas to be compressed from the compression fluid. However, where the containers are not vertically oriented with the gas inlet and outlet at the top, where a gas is used as the compression fluid, or when pumping explosive gases to high pressures, such as 2000 PSI, dividers in the containers are either necessary or preferred. A preferred embodiment of the compressor utilizes two containers in the form of cylinders connected in end-to-end relationship with interconnected, movable dividers in the cylinders. Seals are provided between the dividers and the cylinder walls. This allows complete separation of the compression fluid from the gas being compressed while putting very little, if any, pressure on the seals involved, since the pressures on both sides of each divider are substantially equal.

Because the electrical pumping and control valve portions of the system can be physically separated from the compressor containers where the gas is actually compressed, there is no need to have explosion-proof pump or valves in order to keep the compressor explosion proof. This reduces the cost of components, while still enabling the compressor to be used for compressing explosive gases.

Another aspect of the invention is the provision of a gas storage tank for connection to a gas compressor, whereby substantially the entire contents of the storage tank can be transferred to a second storage tank. This is achieved by progressively lessening the storage area of the tank when it is desired to transfer the gas therein to a second tank, thereby forcing the gas out of the storage tank into the second tank.

THE DRAWINGS

In the accompaning drawings, which represent the best mode presently contemplated for carrying out the invention:

FIG. 1 is a view in vertical section taken axially through a double-cylinder embodiment of the invention and through a connected storage tank for the compressed gas;

FIG. 2, a schematic showing of the double-cylinder and storage tank arrangement of FIG. 1, together with a system for supplying a compression fluid;

FIG. 3, a schematic showing corresponding to that of FIG. 2 but of a different embodiment of the invention;

FIG. 4, a similar schematic showing of a still different embodiment of the invention;

FIG. 5, a view in vertical axial section taken through a different embodiment of cylinder capable of use in the invention; and FIG. 6, a vertical axial section taken through a different embodiment of a closed container of the invention.

DETAILED DESCRIPTION OF THE ILLUSTRATED EMBODIMENTS

Figure 1:
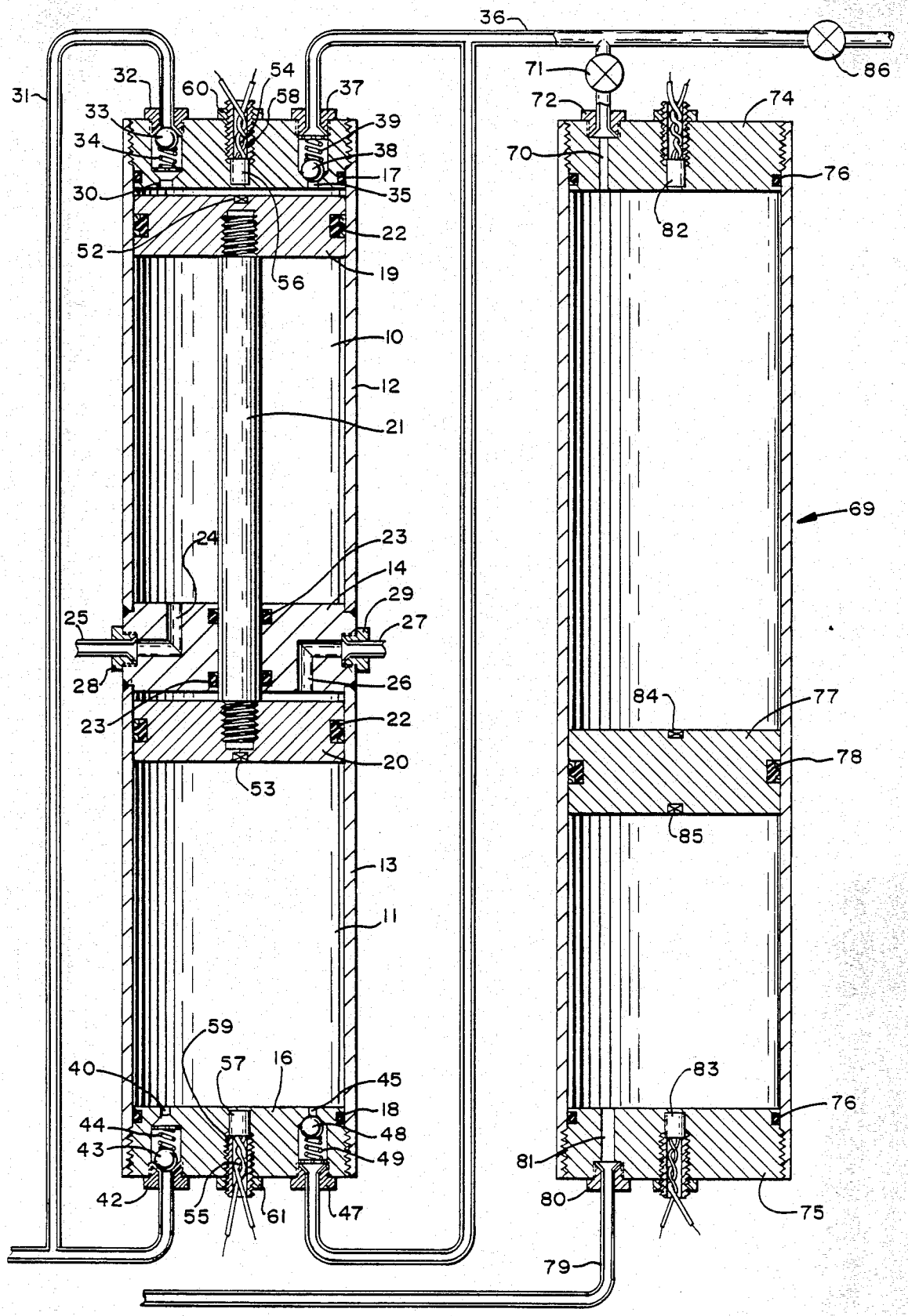

As illustrated in FIG. 1, a preferred embodiment of the invention includes two closed cylinders 10 and 11 interconnected in longitudinal, end-to-end relationship. The cylinders are formed by lengths of steel pipe or tubing 12 and 13, respectively, secured, as by welding, to a center divider 14 which serves in common as an end member for both cylinders. Opposite end members 15 and 16 for the respective cylinders are threaded and screwed into correspondingly threaded ends of the pipe or tubing 12 and 13. O-rings 17 and 18 insure a good seal.

Within cylinders 10 and 11 are dividers 19 and 20, respectively, in the nature of pistons joined by a piston rod 21 so that they move together. Each divider carries a T-seal 22, while the common end member 14 carries seals 23 as normally used in hydraulic systems where piston rod sealing is necessary.

According to the invention, each cylinder includes means for forcing a compression fluid into the cylinder to fill the cylinder as well as means to drain the cylinder of fluid after it has been filled or partially filled. As part of such means, port 24 in end member 14 connects cylinder 10 with fluid line 25, and port 26, also in end member 14, connects cylinder 11 with fluid line 27. Threaded fittings 28 and 29 are used to connect the supply lines to the respective ports. As will be explained later, each of the lines 25 and 27 will alternately act as either a pressurized fluid supply line or a fluid drain line.

Also according to the invention, each cylinder has a gas inlet means for allowing gas to be compressed to enter the cylinder while blocking flow of the gas from the cylinder back out the inlet, and gas outlet means for allowing gas to leave the cylinder while blocking flow of gas into the cylinder through the outlet. In FIG. 1, cylinder 10 has a gas inlet port 30 connected to a gas supply line 31 by threaded fitting 32 and includes ball 33 and spring 34, which form a one way valve so that gas to be compressed can enter cylinder 10 but cannot escape. Cylinder 10 also has a gas outlet port 35 connected to a pressure gas line 36 by threaded fitting 37, and includes a ball 38 and spring 39 arranged as a check valve so that gas can leave cylinder 10 but cannot enter it. Cylinder 11 has a similar inlet port 40 connected to supply line 31 through connector 42, and includes ball 43 and spring 44 as a check valve. It also has a similar outlet port 45 connected to pressure line 36 through fitting 47, and includes ball 48 and spring 49 as a check valve. The strength of the springs are just enough to ensure that the balls seat properly. If natural gas is being compressed, gas supply line 31 is connected to a source of natural gas, such as the gas line in a house. If air is being compressed, the supply line may open directly to the atmosphere, preferably through a filter.

The invention also includes means for alternately operating the means for forcing a compression fluid into a cylinder and the means for draining the compression fluid from a cylinder. As part of such operating means, a sensor may be employed to sense when the divider in a cylinder reaches a desired position within the cylinder. In the embodiment of FIG. 1, in order to sense when a divider has reached its desired position adjacent an end of a cylinder, dividers 19 and 20 have magnets 52 and 53, respectively, embedded in wells therein. Cylinder ends 15 and 16 have wells 54 and 55 which receive magnetic sensors 56 and 57. The sensors are held securely in place by threaded pipe sections 58 and 59 which are locked in place by nuts 60 and 61. A pair of electrical leads 62 extend from each sensor to transmit signals indicative of the state of the sensor, which indicates positions of the dividers. In most cases, the sensor will be an open circuit except when the divider reaches the desired position, at which time the sensor becomes a closed circuit. The exact position of the magnetic sensors may be adjusted by placing shims in the bottom of the wells, with the sensors held securely against the shims by tightening the pipe sections against them and locking them in place with the locking nuts. If the thin wall section at the bottom of the wells are sufficiently strong to withstand the pressures in the cylinder without the reinforcement of the sensor against them, the sensors may be secured directly to the pipe sections and their positions in the wells adjusted by turning the pipe sections. The positioning of the sensors in the wells determine how close to the end of the cylinders the dividers must come before the sensors change state.

It has been found that a Model 1035R12A1 magnetic sensor as manufactured by the Micro Switch Division of Honeywell located in Freeport, Ill., is satisfactory with Micro Switch Model 101MG7 cylindrical magnets embedded in the divider as shown. In order for the magnetic sensors to operate properly, the cylinder ends must be made of aluminum or other nonmagnetic material. If the cylinder ends are made of a magnetic material such as steel, it is necessary to put the sensors in a plug of nonmagnetic material, such as aluminum, for the sensors to operate properly. It should be noted that the particular sensor just specified has three leads rather than two as illustrated and described; however, two of the leads are used as described, the third lead is not used.

A gas storage tank 69 is shown connected to gas pressure line 36 through valve 71 and threaded fitting 72. A gas inlet-outlet to the tank takes the form of port 70. The storage tank is a closed container and may be constructed similarly to the cylinders previously described from a length of tubing or pipe 73 with ends 74 and 75 threaded and screwed into place. O-rings 76 ensure good seals.

While any type of gas storage tank may be used, one aspect of the invention is to provide a storage tank constructed so that substantially the entire contents of the tank can be transfered to a second storage tank, such as a storage tank in a vehicle. The transfer of gas from the tank is accomplished by providing means for progressively lessening the storage area of the tank while gas is allowed to leave the tank, thereby forcing the stored gas from the tank. In the embodiment of the tank shown in FIG. 1, in order to completely empty the storage tank and transfer its contents into another tank, a divider 77 with T-seal 78 is provided within tank 69. A fluid line 79 connected to tank end 75 by threaded connector 80 opens through port 81 into the bottom of the tank. In order to sense the position of the divider at either end of the tank, magnetic sensors 82 and 83 as described for the cylinders are provided in both ends of the tank and magnets 84 and 85 are embedded in opposite sides of the divider. Operation of the tank will be described in connection with the description of FIG. 2.

In addition to its connection to storage tank 60, gas pressure line 36 is connected to valve 86 and then continues on to end in a fitting, not shown, so that it can be easily connected and disconnected to a portable storage tank, such as one in an automobile, or to other equipment which uses the pressurized gas from the compressor or the storage tank. It will be noted that when valve 71 is open and valve 86 is closed, the gas outlet means of the compressor is connected to storage tank 69, and gas from the compressor enters through gas inlet-outlet 70 into storage tank 69. If gas pressure line 36 is connected to a second storage tank and valve 86 opened, the inlet-outlet 70 of the storage tank is connected to the second storage tank so that the gas stored in tank 69 can flow into the second tank. The check valve in the gas outlet means from the compressor cylinder prevents flow of gas back into the compressor. If valve 71 is closed and valve 86 opened, the gas outlet means of the compressor is connected to the second storage tank which may be a tank located in or on a vehicle.

While the cylinders and storage tank may be made in a wide variety of sizes and from a wide variety of materials, it has been found satisfactory and is presently preferred that the cylinders be made of five inch inside diameter steel tubing. The central divider between the cylinders may be steel while the two outside cylinder ends which house the magnetic sensors should be aluminum. The overall length of the cylinder assembly is thirty-six inches. The storage tank may be made of seven inch inside diameter steel tubing with the two ends made of aluminum. The length of the storage tank is preferably about fifty-four inches. The dividers in both the cylinder and storage tank may be made of aluminum.

Also, while a magnetic sensor has been described as the preferred sensor, various other sensors could easily be substituted such as mechanical limit switches made by Square D Company of Palatine, Ill., No. 9007B62A2 being satisfactory, which are coupled to an arm that extends through the cylinder ends and is actually contacted by and moved by the divider as it reaches the desired position at the end of the cylinder. Various other sensing techniques may also be used such as sensing the pressure of the fluid which will increase substantially instantaneously when the divider hits against the end of a cylinder.

Figure 2:
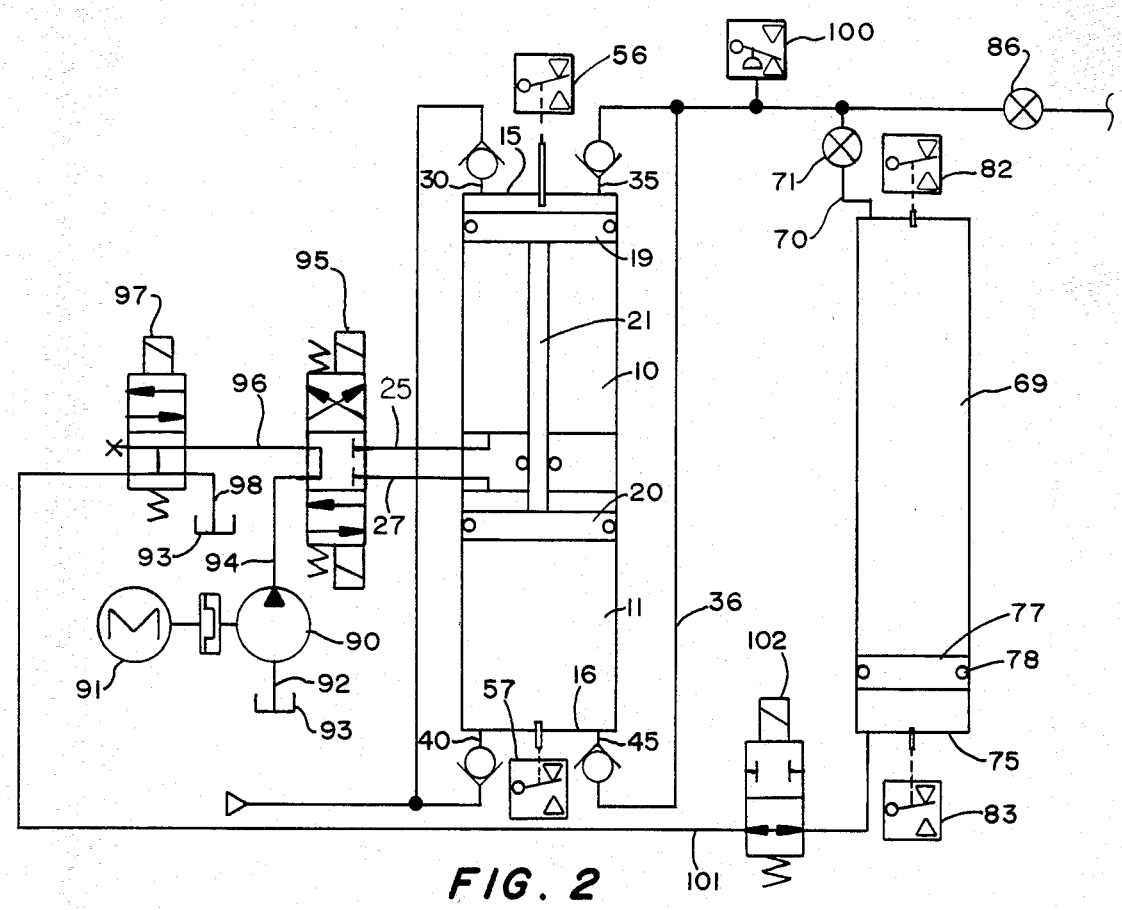

FIG. 2 shows the cylinder and storage tank arrangement of FIG. 1 in schematic form and shows the arrangement of valves and a pump to operate the system. The arrangement of valves and the pump, along with the fluid lines shown, constitute an embodiment of the means for forcing the compression fluid into the cylinder and the means for draining the cylinder. An embodiment of the means for alternately operating the forcing means and the draining means are the controls which operate the pump and the valves in response to signals from the sensors described. Also, the pump and valves and the fluid line to the storage tank 69 along with the divider in the storage tank constitute an embodiment of the means for progressively lessening the storage area of the tank.

The intake of a pump 90, which includes motor 91, is connected through conduit 92 to fluid reservoir 93. The outlet of the pump is connected through conduit 94 to a three position valve 95, which, in a first position, bottom position shown, connects the output of the pump to conduit 27, which directs the fluid to cylinder 11. Line 25 from cylinder 10 is connected through valve 95 to line 96 which connects to a two position valve 97. The ports of valve 97 in the position shown are all connected in common to fluid line 98, which is in communication with fluid reservoir 93. Although reservoir 93 is shown separated for ease of illustration, it is a single reservoir. With valve 95 in its first position and valve 97 in the position shown, fluid from pump 90 is forced into cylinder 11, forcing divider 20 downwardly in cylinder 11. This causes the gas in cylinder 11 to be forced through outlet 45 into gas pressure line 36 and, with valve 71 open and valve 86 closed, into storage tank 70. As divider 20 moves toward end 16 of cylinder 11, divider 19 moves toward end 14 of cylinder 10. Fluid from cylinder 10 flows through line 25, valve 95, line 96, valve 97, and line 98 into fluid reservoir 93. Also, gas to be compressed is drawn into cylinder 10 through inlet 30. Valve 95 is electrically controlled so that when sensor 57 changes state, indicating that divider 20 has reached its desired position at the end of cylinder 11, valve 95 is switched to its third position whereby the output of pump 90 is connected through valve 95 to line 25 and cylinder 10 while cylinder 11 is connected through line 27, valve 95, line 96, valve 97, and line 98 to fluid reservoir 93. With valve 95 in this position, the output of pump 90 is connected to cylinder 10 and forces divider 19 toward end 15, thereby compressing the gas in cylinder 10 and forcing it through outlet port 35 into gas pressure line 36 and storage tank 70. At the same time, fluid from cylinder 11 flows into reservoir 93 and gas to be compressed is drawn into cylinder 11 through inlet 40. When divider 19 reaches the end of cylinder 10, sensor 56 changes state causing valve 95 to move to its first position wherein the pump output is connected to cylinder 11 and movement of the divider is again reversed. This back and forth movement of the piston is repeated continuously until the pressure in the storage tank as measured in gas pressure line 36 by pressure sensor 100 reaches the desired value. Upon reaching the desired valve, pressure switch 100 changes state, generally opening the motor control circuit, thereby causing pump motor 91 to stop. This stops operation of the pump until pressure drops below the desired value at which time the sensor 100 again changes state to close the motor control circuit and start operation of pump motor 91.

It will be noted that at the beginning of the operation of the compressor, the pressure in the cylinder through the entire stroke will be relatively low and that as the pressure in the storage tank and line 36 increases, the pressure, at least at the beginning of the stroke in each cylinder, will still be relatively low. It is therefore desireable to use a variable pump which will pump the compression fluid at a relatively high rate at low pressures and will pump at a reduced rate, so as to stay within the power rating of the pump, at higher pressures. A continuously variable pump is preferred but for lower horsepower rated pumps, those below five horsepower, pumps having two pumping rates are more readily available. With such pumps, a relatively high pumping rate of about four gallons per minute (gpm) is maintained until a pressure of about 600 PSI is reached, at which time the pumping rate is reduced to about one gpm. Also, since the pressure of the gas being compressed is just slightly less than the pressure of the compression fluid, there is substantialy no pressure drop across the piston seals so substantially no leakage about such seals occurs.

When used to compress natural gas, the compressor will usually be used to fill the natural gas storage tanks in an automobile or similar vehicle over an extended period of time, such as over-night, and will fill such tank usually to a pressure of about 2400 PSI. The embodiment shown is not a high capacity compressor so several hours or more are required to fill the one or two storage tanks normally used in a vehicle. When filling such tanks, the gas pressure line 36 is connected to the tank and any tank valves are opened. The one way valves usually provided with such tanks need not be manually opened. Valve 71 to storage tank 70 is closed and valve 86 in line 36 opened. The pressure in line 36 will drop below the desired 2400 PSI and the compressor will begin to operate and continue to operate until the pressure in the tank and pressure line 36 reach the desired 2400 PSI. The pump will then be shut off by action of pressure switch 100. Valve 86 is then closed along with any tank valves on the vehicle and the pressure line disconnected.

It will be noted that with the above described operation, storage tank 69 is not used and is not necessary. Thus, where only extended period filling of the vehicle tank is required, no addition storage tank 69 is needed. However, in some instances, it is desireable to be able to rapidly fill a vehicle tank. This is the situation in which storage tank 69 is used. In such instances, the vehicle tank is connected to gas pressure line 36 and the tank valves as well as valves 86 and 71 opened. The gas stored in tank 69 thus flows into the vehicle tank. However, it will be realized that all gas from tank 69 will not flow into the vehicle tank, and, depending upon the relative volumes of the two tanks, the pressures in the two tanks will not remain at the desired 2400 PSI. If the volume of storage tank 69 is very large compared to the volume of the vehicle tank to be filled, the pressure in the two tanks will remain close to the desired 2400 PSI. However, if the volume of tank 69 is equal to the volume of the tank to be filled, when the two tanks are connected, the gas in tank 69 spreads into effectively a total volume twice as large as its original volume and, neglecting the affect of temperature drop of the expanding gas on its pressure, theoretically its pressure drops to one-half its original pressure, or 1200 PSI. If the volume of tank 69 is twice that of the tank to be filled, after expansion into the tank to be filled, the pressure will theoretically be two-thirds that of the original pressure in tank 69. Because of temperature changes, and because the behavior of real gases at various pressure do not follow theory exactly, the pressure will actually drop more than indicated above. Usually in order to fill a tank of a certain size to 2400 PSI it is necessary to have a tank or tanks of total volume four times the volume of the tank to be filled and at a pressure of about 3000 PSI. When connected to the tank to be filled, the gas in all tanks is reduced to about the desired 2400 PSI. With such a set up, the compressor is always working to refill the large tank or tanks from 2400 PSI to 3000 PSI. Compression at high pressure takes more energy than compression at lower pressures. Thus, the more compression that can be done at lower pressure the better. In order to avoid having to use a very large storage tank or to fill a tank to higher pressures than needed, both of which are expensive, it is desireable to be able to completely empty a smaller storage tank into the tank to be filled.

With the storage tank of the invention, when valves 86 and 71 are opened so that the contents of tank 69 is distributed between the two tanks, valve 95 is switched to its second, or center position, the position illustrated, and valve 97 is switched to its second position. This may be done by a switch, activated manually, which causes valves 95 and 97 to move to the position indicated. With valves 95 and 97 in those positions, the output of pump 90 flows through line 94, through valve 95 directly to line 96, through valve 97 to line 101 which connects to the bottom of storage tank 69. As the pump operates, divider 77 in tank 69 is forced upwardly thereby forcing the gas out of tank 69 into the vehicle tank. The pump will be pumping at its slow, high pressure rate, since for equal size tanks the pressure will have only dropped to a pressure somewhat below 1200 PSI and will be increased to 2400 PSI. However, it will generally take less than ten minutes to empty tank 69 and fill the vehicle tank to 2400 PSI.

Sensor 82 will change states when piston 77 in storage tank 69 reaches the desired position at the top of the tank and will cause valve 95 to leave its center or second position and valve 97 to return to its first position so that operation of the compressor may begin and so that line 101 from tank 69 is connected through valve 97 to line 98 and fluid reservoir 93. In such position, fluid can drain from the storage tank back into reservoir 93. The check valve on the vehicle tank will prevent the gas in that tank from expanding back into storage tank 69. As the pressure is released on the fluid in storage tank 69 so that it can drain back into the reservoir, the pressure in the system will drop so that pressure switch 100 will start operation of the pump again which now starts operation of the compressor to again fill tank 69. Before the vehicle tank is disconnected from line 36, valve 86 is closed so that gas cannot escape and pressure built up in tank 69 remains in the tank. The fluid from the tank can drain by gravity or be forced out of the tank by gas entering the tank. When the pressure on the fluid is first released, the pressure in the gas lines to the vehicle tank will cause some movement of the divider and drainage of the fluid.

Fluid line 101 from tank 69 remains connected through valve 97 to the fluid reservoir so fluid drains out and the divider 77 moves to the bottom of the tank.

If the fluid is allowed to completely drain from the tank as gas pressure builds up in the tank, the pressure will appear across the divider seal 78. When explosive gases are being compressed, it is desireable to provide some back up system or seal to ensure that any gas that might leak through seal 78 does not get into the fluid. For this purpose, it is preferred that when divider 77 reaches a desired position at the bottom of the tank just prior to complete draining of the fluid therefrom, sensor 83 be set to change state and operate a valve 102 in line 101 thereby closing the valve. In this way some fluid remains at the bottom of the tank. As pressure builds up in the tank, substantially equal pressure builds up in the fluid so the gas and fluid are at substantially no pressure differential across the divider seal 78. This substantially prevents any leakage of gas around seal 78. Rather than closing the fluid line 101, other methods of ensuring a complete seal so that gas cannot escape into the fluid line may be used, such as providing an additional seal about the outside of the bottom of the tank so that the divider will have two seals blocking leakage of gas. If valve 102 is used, the same switch used to change valves 95 and 97 to supply fluid to the storage tank would also open valve 102.

For the embodiment shown in FIG. 2, it has been found satisfactory to use a Stone Model P20M9VIT12 pump unit as manufactured by Stone Hydraulic Industries, Inc., Rockford, Ill. which includes a 1.5 horsepower motor as the pump and motor, 90 and 91, respectively, a Rexroth Model 4WE6G-XX/G24ND/5 three position, solenoid operated control valve as valve 95, and a Rexroth 4WE6HB-XX/G24ND/5 two poition, solenoid operated control valve as valve 97. Both valves are made by Rexroth Industrial Division in Bethlehem, Pa. The pressure switch 100 may be a CanFlo CFSPX2500-R-4BEL made by Can-Flo Corp. of Royal Oak, Mich. A type DTE 24 high temperature hydraulic fluid has been found satisfactory for use in the system.

Figure 3:
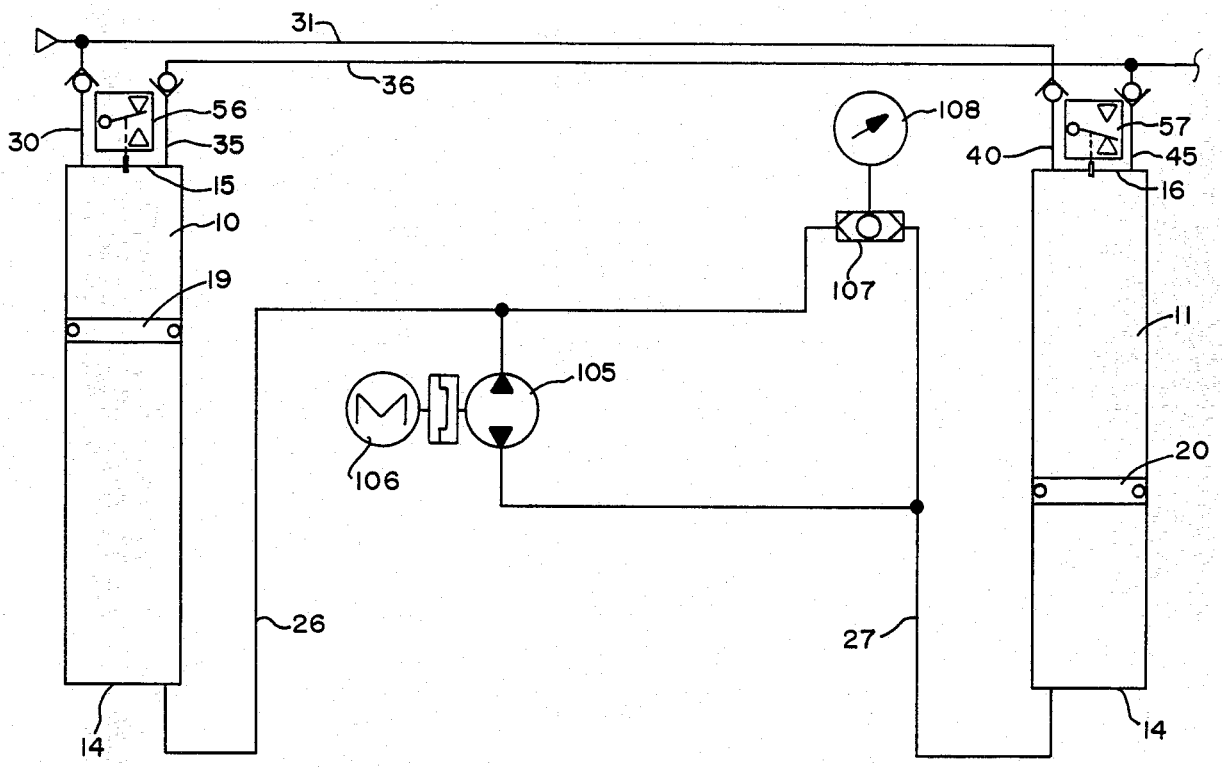

FIG. 3 shows a slightly different arrangement of the compressor apparatus of the invention. Rather than having the two cylinders arranged end-to-end as in FIGS. 1 and 2, the cylinders are separate as illustrated schematically. However, the same reference numbers as used in FIGS. 1 and 2 for corresponding parts will be used.

Rather than using an open fluid reservoir and unidirectional pump with the accompanying valves for fluid flow switching, a reversable pump 105 with motor 106 in a closed hydraulic system is used. Thus, one input-output of the pump is connected directly to line 25 leading to cylinder 10 while the other input-output is connected directly to line 27 leading to cylinder 11. To measure pressure in the lines, a shuttle valve 107 is connected across lines 25 and 27 and is connected to pressure gauge 108. With shuttle valve 107, the gauge 108 will always read the pressure in the line into which fluid is pumped under pressure.

In operation of the compressor of FIG. 3, pump 105 will pump fluid into line 26 and cylinder 10 until the divider reaches the desired location at the top of the cylinder, at which time sensor 56 changes state causing pump 105 to change direction and pump the fluid from cylinder 10 into line 27 and cylinder 11. This causes divider 20 to move upwardly in cylinder 11, compressing the gas therein.

When the divider reaches the desired position at the top of cylinder 11, sensor 57 changes state causing the pump to again reverse and fluid to be pumped from cylinder 11 into cylinder 10.

A Cesna No. 70142RAR variable volume reversible pump has been found satisfactory. It is a variable volume pump so that the flow rate is adjusted to the fluid pressure. Also, it has included therein a make up pump with closed reservoir so that any fluid leakage in the pump is made up to insure that the full amount of fluid is pumped into each cylinder on each stroke, and has internal cross relief valves so that if a blockage occurs in the fluid lines or the cylinder, excessive pressure will not build up in the system and cause it to burst. These features of the pump should preferably be present in any reversable pump used.

A storage tank similar to that shown in FIG. 2 is not shown as part of the system in FIG. 3, but could easily be added, if desired, by adding a valve wherein the storage tank could be filled and drained as one cycle of the pump, or by adding an additional pump and fluid reservoir to operate the storage tank divider.

While the fluid line pressure gauge 108 is illustrated as merely a gauge for observation. The gauge could be replaced by a pressure sensor similar to sensor 100 in FIG. 2 which would sense the pressure and change states when the pressure rose above a certain valve. The operation of the system can all be controlled from such a pressure sensor. For example, the pressure sensor could be set to sense 2400 PSI. If the system is set so that fluid is being pumped into cylinder 10, when divider 19 reaches the top of the cylinder so there can be no more movement of the divider, the pressure of the fluid increases immediately and exceeds the 2400 PSI setting of the sensor. The sensor would change state and cause the motor to reverse (or the system of FIG. 2 to switch) so that fluid would then be forced into cylinder 11 causing divider 20 to move compressing the gas in cylinder 11. The pressure in the fluid line would immediately drop below the 2400 PSI setting and the sensor would return to the original state without changing direction of fluid flow. When divider 20 reaches the end of cylinder 11, the pressure in the line would again increase above 2400 PSI causing the sensor to change state again reversing flow in the system. The system would continue to operate in this fashion until the pressure in the storage tank reached 2400 PSI when a pressure sensor in the gas pressure line, such as 100 in FIG. 2, would change state to stop operation of the compressor, or if no pressure sensor is used in the gas pressure line, the continued operation of the compressor will cause the pressure to build up in the compressor cylinders so that the stroke in the cylinder necessary to compress the gas therein will get shorter and shorter. A delay means can be provided so that if the sensor does not stay below 2400 PSI for a set period of time, less than the shortest time necessary for a complete filling of the cylinder under normal operations, the system would shut off.

Use of the dividers within the cylinders is necessary where the compression fluid is a gas to prevent mixing of the compression fluid (gas) with the gas being compressed. It is also necessary where the compression fluid is a liquid and both cylinders are not vertically oriented, as is the case when the two cylinders are joined end-to-end as in FIGS. 1 and 2, to keep the compression fluid from running to the end of the cylinder where the gas being compressed is expelled. When the cylinders are vertically arranged, as with the system of FIG. 3, dividers are not necessary since there will generally be no substantial mixing at the liquid-gas interface. When compressing explosive gases to high pressures such as the 2400 PSI described above, the dividers are presently preferred to eliminate any possibility that the explosive gas might dissolve in the fluid and cause the fluid to foam when pressure is released, or come out of the fluid when pressure is released and build up in the fluid lines, the pump, or in a fluid reservoir, thus interfering with systems operation or causing a hazardous condition. At the present time it is not known whether such dissolving of the gas will occur or if it would cause problems, thus it is not currently known if the dividers in this circumstance are necessary.

When no divider is used, a ball float valve may be used on the gas input and output at the top of the cylinder to ensure that fluid does not enter the gas lines, and a sensor such as one coupled to a float may be used to sense when the fluid has reached the top of the cylinder. Of course, the same fluid pumping and valving systems as shown for either FIG. 2 or 3 may be used without the dividers. Also, the storage tank as described in FIGS. 1 and 2 may be used without the divider. The dividers may also be of types other than that illustrated. Various movable dividers which slide within the closed container may be used or dividers such as flexible membranes or other material secured within the container but free to conform to the inside of the container and the interface may be used.

The operation of the illustrated systems has been described without illustrating the electrical control system. Such system would be obvious from the operation described and the components could easily be connected by one skilled in the art. Therefore, the electrical connections have not been shown or described in detail.

Figure 4:
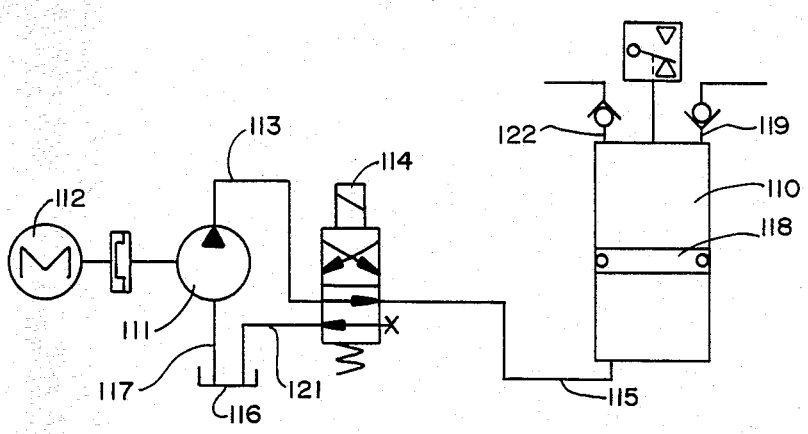

FIG. 4 shows schematically a single cylinder embodiment of the invention. The cylinder 110 may be constructed similarly to the cylinders of FIG. 3, or in any other suitable manner. A pump 111 with motor 112 which may be a pump as described in connection with FIG. 2, or may be a Cessna Model 1.16 variable displacement pump, has its output connected through line 113 to solenoid operated two position valve 114. In the position shown, the valve connects the output of the pump to line 115 which connects to the bottom of cylinder 110. Fluid is drawn from fluid reservoir 116 through line 117 to the pump where it is forced through line 113, valve 114, and line 115 into cylinder 110. This forces divider 118 to the top of the cylinder, thereby compressing the gas in the cylinder and forcing it out the gas outlet 119. When divider 118 reaches the top of cylinder 110, sensor 120 changes state which causes valve 114 to change position and pump 111 to stop. In the second position of the valve, line 115 from cylinder 110 is connected to line 121 which is connected to reservoir 116. Fluid from cylinder 110 thus drains from the cylinder, through line 115, valve 114, and line 121 to reservoir 116. Divider 118 moves downwardly in the cylinder as the fluid drains. If the gas inlet 122 to the cylinder is connected to the natural gas line in a home or other building, the gas is under a pressure of about 5 PSI which forces the gas into the cylinder 110 and helps force the fluid out and the divider to the bottom. If air is being compressed, the inlet will probably be open to the atmosphere so the cylinder will drain, and the divider move, by gravity. A timing circuit can be connected to valve 114 so that it remains in its second or drain position for a set amount of time (the amount of time determined necessary for substantially complete drainage of the cylinder) before valve 114 is changed back to its first position and the pump started to again fill cylinder 110 with fluid. This sequence will be repeated until the desired pressure in the gas supply line and storage tank is reached as sensed by any of the methods already described.

Figure 5:
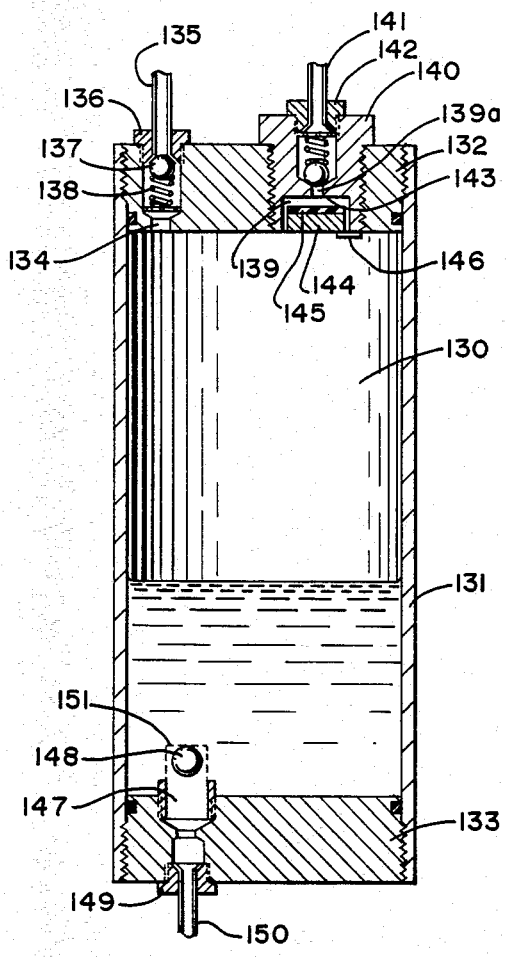

FIG. 5 shows an embodiment of a cylinder without a divider for use in a system such as shown in FIGS. 3 or 4 where the cylinder or cylinders are arranged vertically with gas inlet and outlet at top.

The cylinder 130 is made of tubing 131 with ends 132 and 133 threaded and secured in place. The tubing and ends may be made of steel or other suitable material such as aluminum.

Gas to be compressed enters the cylinder through port 134 from gas supply line 135 which is connected through threaded fitting 136. Ball 137 and spring 138 form a one way check valve for the gas and also keeps fluid from entering the gas supply line.

Compressed gas leaves the cylinder through port 139 in threaded fitting 140 which has a pressured gas line 141 connected thereto through threaded fitting 142. Port 139 has a narrow portion **139*a* which forms shoulder 143. A cylinder 144 with upper resilient portion 145 is positioned in the lower, wide portion of port 139 and is held in place by a flange 146 securred to fitting 140**.

At the lower end of the cylinder is a fluid port 147 adapted to receive a ball 148 therein. Port 147 is connected through threaded fitting 149 to fluid line 150. A screen cover 151 over port 147 holds ball 148 in place over the port.

In operation of the cylinder, a fluid such as hydraulic fluid or water is forced into the cylinder through port 147. Ball 148 is of a density so that it floats in the fluid so rises from port 147 to the top of cover 151 as the fluid rises in the cylinder. As the fluid rises, it compresses the gas in the cylinder and forces it out port 140 about cylinder 144, 145. When the fluid reaches the top of the cylinder it is blocked by the gas built up in inlet port 134 by reason of check valve ball 137 blocking flow of gas back into gas supply line 135 so starts to rush into gas outlet port 139. Although cylinder 144, 145 is not necessarily buoyant in the fluid, the rush of fluid into the wide portion of port 139 moves the cylinder ahead of it to seat the resilient portion 145 against shoulder 143 thereby closing the outlet to fluid flow. The pressure in the fluid immediately builds up, the increased pressure being sensed by a pressure sensor in the fluid supply line as hereinbefore explained which reverses fluid flow to drain the cylinder. As the fluid starts to drain, cylinder 144, 145 drops to open outlet port 139, flow of compressed gas back into the cylinder being blocked by ball 152. As the fluid drains, gas enters the cylinder through inlet 134. If the gas to be compressed entering the cylinder is under slight pressure, as is natural gas in a home gas line, this pressure helps force the fluid from the cylinder. If the gas is not under pressure, such as the inlet merely being open to the atmosphere, the fluid drains by gravity. The fluid line could be connected to a pump and the fluid pumped out, such as would be the case if used in a system as shown in FIG. 3, or similar system. In such case, the pumping out if the fluid would draw gas in through the inlet.

As the fluid gets to the bottom of the cylinder, ball 148 moves to the bottom of the cylinder and seats in port 147 to prevent gas from entering the fluid supply line. If a pump is being used to remove the fluid from the cylinder, the pressure required to draw the fluid against a vacuum when ball 148 seats can be sensed and used to reverse flow of the fluid. If gravity draining is used, reversal of fluid flow may be accomplished by a timer set to allow the fluid to drain for a set amount of time. If in the system of FIG. 3 or a similar system, reversal of fluid flow will be caused by the second cylinder filling and causing reversal of fluid flow. In addition to holding ball 148 in place, screen or wire cover 151 also serves to eliminate any vortex that might be formed as the fluid is draining so that gas does not enter the fluid line.

It will be realized that various types of sensors can be used in the cylinder to sense the fluid level in the cylinder, and when non-explosive gases are being compressed, two electrodes could be inserted through the cylinder ends to extend to the desired level. When the fluid reaches the desired level, it contacts the two electrodes causing a current to be conducted between them. Such a sensor could be used at both top and bottom of the cylinder, as could a wide variety of other sensor obvious to one skilled in the art.

Figure 6:
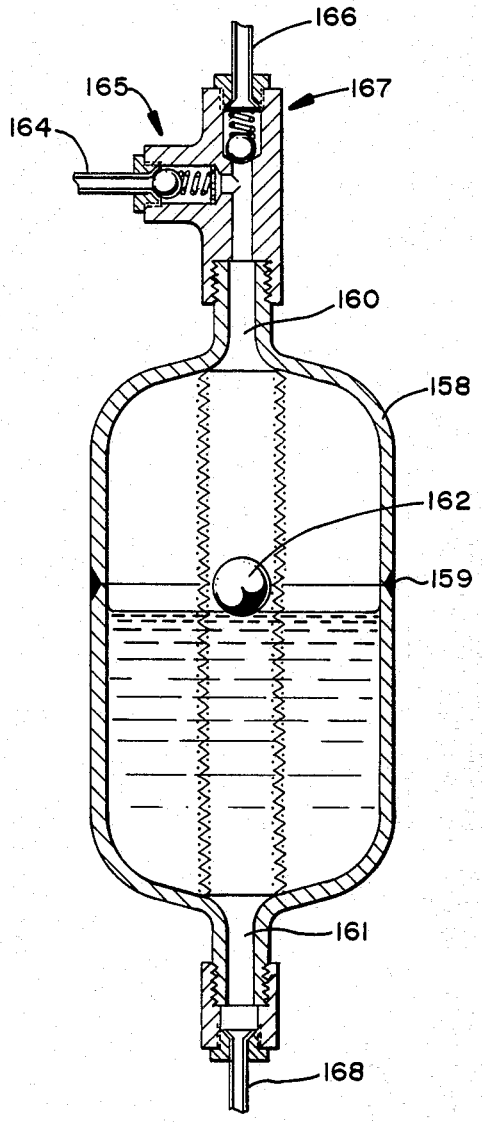

FIG. 6 shows still another embodiment of a closed container for use with the invention and may be used in the systems of FIG. 3 or 4 or similar systems where the container is maintained in vertical position.

The container 158 is formed from two halves joined at 154, such as by welding with a gas inlet-outlet 160 at the top and a fluid inlet-outlet 161 at the bottom. A ball 162 adapted to float in the fluid used and to seat in both the gas inlet-outlet 160 and the fluid inlet-outlet 161 is guided in a screen or wire tube 163. Thus, as fluid is forced into container 158, ball 162 rises with the fluid and when the fluid reaches the top of the container, the ball seats and seals inlet-outlet 160. As the fluid drains, the ball follows the fluid level downwardly until it seats and blocks fluid inlet-outlet 161. A gas inlet line 164 and associated check valve 165 and a gas outlet pressure line 166 with associated check valve 167 are connected to inlet-outlet 160, while a fluid supply line 168 is connected to inlet-outlet 161. Operation is similar to that described for the other embodiments. Rather than having the ball 162 travel the entire length of the container, a separate ball and cage could be provided at both the top and bottom of the container, similar to that shown in the bottom of the cylinder of FIG. 5.

The gas storage tank for complete transfer of the gas stored therein as described for FIGS. 1 and 2 could easily take the form of any of the cylinders described.

It will be realized that various gases may be compressed with the invention described and that, where gases such as air are compressed which are used to power equipment, the gas pressure line will be connected to a normal storage tank without the transfer feature, since, in such circumstance, the gas is merely withdrawn and used as necessary. When the pressure in the tank drops, the compressor starts and the gas used is replenished.

The compressor of the invention is easily made explosion-proof by separating the electrical components, such as the pump and valves, from the actual compression containers. Thus, the electrical components, except some of the sealed and explosion-proof sensors that may be used, can be located in a completely separate room separated by a wall from the compression containers and any portion of the system where explosive gas is present. The only connections between the two portions of the systems are through the hydraulic lines and connection to any sensors that may be used.

The system could be used for supplying pressurized natural gas for use in vehicles as described, and also be used for compressing air, by merely switching a valve that would open the gas inlet to the atmosphere, and by switching a valve that would connect the gas pressure line to an air storage tank rather than the natural gas storage tank.

An additional safety feature of the system is to select a pump motor with overload protection so that when the pump output reaches a preset pressure, such as 3000 PSI, the overload protection will shut off the pump. In this way, if the sensor for shutting off the system malfunctions, the system will still be shut off before excessive pressure builds up that could cause an explosion. Of course, the pressure at which the overload would shut off the system would be selected in accordance with the maximum desired pressure to be obtained from the system.

The compression fluid used may be a hydraulic fluid such as a special fluid or merely water, or may be a gas such as air. Thus, if high pressure air compression equipment is available but it is not explosion proof, the high pressure air can be used to power the compressor of the invention to compress explosive gases.

While the valves have been described as operated electrically, the valves could be operated in other ways, such as hydraulically.

Also, while sealed dividers have been described, dividers which are not sealed may be used where it is merely desireable to limit the possible area of contact between the gas and the compression fluid.

It will also be realized that the storage tank of the invention which enables the tank to be substantially emptied of gas stored therein may be used with any of the embodiments of the compressor disclosed herein, or may be used with any other type of gas compressor to reduce the size of the storage tanks normally used and the pressure at which the gas in such tanks must be stored. Also, any size storage tank may be used or several of the tanks may be connected to a compressor and to an output in parallel or series.

Whereas the invention is here illustrated and described with respect to embodiments thereof presently regarded as the best mode of carrying out such invention, it is to be understood that various changes may be made in adapting the invention to different embodiments without departing from the broader inventive concepts disclosed herein and comprehended by the claims that follow.

We claim:

1. A high pressure compression system for compressing natural gas to a pressure sufficient for filling the pressure tank of a vehicle adapted to run on natural gas comprising a gas storage tank having the capability to transfer substantially its entire contents of stored gas to the pressure tank; an inlet-outlet for compressed gas at one end of the storage tank; at least one closed container; gas inlet means for filling the container with gas to be compressed; gas outlet means connected to the inlet of the gas storage tank for allowing the gas to leave the container as it is being compressed and enter the storage tank; means for forcing a compression fluid into the container to fill the container, thereby compressing the gas and forcing it through the gas outlet means, such forcing means having a variable rate of forcing the compression fluid into the container so that a greater flow rate into the container is obtained when the fluid is forced against relatively low pressures compared to the maximum desired pressure and a lesser flow rate into the container is obtained when the fluid is forced against relatively high pressures; means for draining the container of the compression fluid while again filling the container with gas to be compressed; means for alternately operating the forcing means and draining means until a desired pressure of gas has been obtained in the gas storage tank; means for connecting the outlet of the gas storage tank to the pressure tank to be filled; and means for progressively lessening the storage area of the storage tank while gas is allowed to leave the storage tank, thereby forcing the gas stored in the storage tank out of the tank and into the pressure tank.

2. A high pressure compressor system according to claim 1, wherein a single container is used, wherein the compression fluid is a liquid, wherein the means for forcing the compression fluid into the container and means for draining the container is a liquid pump in combination with a valve, fluid lines communicating with the container, the pump, and a fluid reservoir, so that the valve is operated to connect the pressure output of the pump to the container when the fluid is to be forced into the container and the valve is operated to connect the container to the reservoir when the fluid is to be drained from the container.

3. A high pressure compressor system according to claim 2, wherein the pump is shut off when the valve is in position to drain the container.

4. A high pressure compressor system according to claim 2, wherein the means for alternately operating the forcing means and draining means includes a sensor to sense when the fluid level reaches a desired position at the end of the container containing the gas outlet and means for switching the valve and stoping operation of the pump for a set period of time sufficient to substantially drain the container of fluid.

5. A high pressure compression system according to claim 1, wherein the means for progressively lessening the storage area of the storage tank includes a transfer fluid inlet at the side of the storage tank opposite the side through which the compressed gas enters and leaves, means for forcing a transfer fluid into the storage tank to thereby force the compressed gas out of the storage tank, and means for draining the fluid from the storage tank after the gas therein has been transferred.

6. A high pressure compressor system according to claim 5, wherein the storage tank is in the form of a cylinder and the compressed gas enters and leaves through one end of the cylinder while the transfer fluid enters and leaves through the opposite end.

7. A high pressure compressor system according to claim 6, wherein a divider is positioned in the cylinder to separate the compressed gas from the transfer fluid.

8. A high pressure compressor system according to claim 7, wherein the means for forcing a fluid into the storage tank is the same means for forcing a compression fluid into the cylinders of the compressor and wherein valves selectably direct the fluid to either the cylinders of the compressor or to the storage tank.

9. A high pressure compressor system according to claim 8, wherein a pressure sensor is located to sense the pressure of the gas in the storage tank and wherein signals from the pressure sensor are used to control operation of the compressor and storage tank transfer.

10. A high pressure compressor system according to claim 9, wherein a sensor is provided in the storage tank to sense when the divider reaches a desired position at the end of the cylinder through which the compressed gas leaves.

11. A high pressure compression system according to claim 10, wherein the sensor is a magnetic sensor positioned in the end of the storage tank through which the gas leaves and a magnet located in the divider.

12. A high pressure compression system according to claim 11, wherein the divider is provided with a seal between it and the cylinder walls and a sensor is also provided at the end of the storage tank through which the transfer fluid enters to sense when the divider reaches a desired position at that end of the storage tank, and wherein a means to stop transfer fluid flow is provided and operates in response to the sensor to block further flow of the transfer fluid so that at least enough fluid remains in the storage tank to substantially equalize the pressure on both sides of the divider seal.

13. A gas compressor according to claim 1; wherein there are two containers and wherein the means for forcing a compression fluid into the container and the means for draining the compression fluid from the container are adapted such that as one container is being filled with compression fluid, the other container is being drained.

14. A high pressure compressor system according to claim 13, wherein the compression fluid is a liquid and wherein the means for forcing the compression fluid into the container and means for draining the container is a reversable liquid pump and fluid lines communicating with the containers so that fluid is pumped from one container into the other container in one flow direction of the pump while flow is reversed in the other flow direction of the pump.

15. A high pressure compressor system according to claim 14, wherein the fluid pump automatically and continuously varies its pumping rate according to the pressure at the pump pressure outlet of the fluid being pumped so as to pump as much volume of fluid as possible at any given pressure but still remain within the power rating of the pump.

16. A high pressure compressor system according to claim 13, additionally including dividers in each container to separate the compression fluid from the gas being compressed.

17. A high pressure compressor system according to claim 16, wherein the dividers are sealed to completely eliminate direct contact between the compression fluid and the gas being compressed.

18. A high pressure compressor system according to claim 17, wherein the containers are in the form of cylinders and the dividers are movable within the cylinders from one end to the other.

19. A high pressure compressor system according to claim 18, wherein the cylinders are arranged in longitudinal, end-to-end configuration and the dividers in each cylinder are connected so that each will move equally in their respective cylinders.

20. A high pressure compressor system according to claim 19 wherein the sensors which sense when a cylinder has been filled to desired capacity are magnetic sensors in the outside end of each cylinder and a magnet embedded in each divider so that as a divider reaches a desired position toward the end of a cylinder, the sensor is activated by the magnet.

21. A high pressure compressor system according to claim 20, wherein the compressor outlet is connected to a gas pressure line and wherein a pressure sensor is located to sense the pressure in the line and stop operation of the compressor when a desired pressure is sensed in the line.

22. A high pressure compressor system according to claim 13, wherein the compression fluid is a liquid and wherein the means for forcing the compression fluid into the container and the means for draining the container is a liquid pump in combination with a valve and fluid line communicating with the containers so that liquid is pumped from one container into the other container in one position of the valve while flow is reversed in a second position of the valve.

23. A high pressure compressor system according to claim 22, wherein the valve is electrically operated and wherein the means for alternately operating the forcing means and draining means includes a sensor to determine when the fluid has filled a container to the desired capacity and means to operate the valve to reverse fluid flow in response to signals from the sensor.

24. A high pressure compressor system according to claim 23, wherein the fluid pump automatically varies its pumping rate according to the pressure at the pump pressure outlet of the fluid being pumped so as to pump more volume of fluid at a given pressure, but still remain within the power rating of the pump, than would be the case if the pump had a single constant pumping rate.

25. A high pressure compressor system according to claim 24, wherein the fluid pump has two pumping rates, a relatively fast rate when pumping against relatively low pressure and a relatively slow rate when pumping against relatively high pressure.

26. A high pressure compressor system according to claim 24, wherein the fluid pumping rate is continuously variable.

27. A high pressure compressor system according to claim 23, wherein the sensor is a fluid pressure sensor located in communication with the outlet of the pump to sense a desired pressure of the fluid being pumped.

28. A high pressure compressor system according to claim 27, wherein a fluid stop is provided at the end of each container at which the gas outlet is located to stop flow of the fluid and allow pressure build up in the fluid.

29. A high pressure compressor system according to claim 28, wherein dividers are additionally included in each container to separate the compression fluid from the gas being compressed and the fluid stop in each container is the divider in that container which blocks further flow of compression fluid into the container when it reaches the end of the container.

30. A high pressure compressor system according to claim 28, wherein the fluid stop is means to block the gas inlet means and the gas outlet means to fluid flow.

31. A high pressure compressor system according to claim 30, wherein the means to block fluid flow is a check valve in both the gas inlet means and the gas outlet means.

32. A high pressure compressor system according to claim 31, wherein the check valve in the gas outlet means is closed by the presence of fluid.

33. A high pressure compressor system according to claim 28, wherein the container also includes means to block the fluid line when fluid has substantially drained from a container to prevent gas to be compressed from entering the fluid line, valve or pump.

34. A high pressure compressor system according to claim 33, wherein the means to block the fluid line is a check valve including a ball which floats in the fluid and which seats to block the fluid flow when fluid reaches the bottom of the container.

35. A high pressure compressor system according to claim 34, wherein the gas inlet means and gas outlet means communicate with the container through a single port adapted to receive and seat therein a member which will block the port to fluid flow.

36. A high pressure compressor system according to claim 35, wherein a float member which will float in the fluid is provided within the container and wherein the container includes a guide for the float member so as the fluid in the container rises, the float member will rise with the fluid and will block the gas port as the fluid reaches such port, and as the fluid drains, the float member will fall with the fluid to block the fluid line when the fluid is substantially drained.

* * * * *